US005377837A

United States Patent [19]

Roussel

[11] Patent Number: 5,377,837

[45] Date of Patent: Jan. 3, 1995

[54] FLEXIBLE BAG FOR PACKAGING COMPRESSIBLE PRODUCTS, PARTICULARLY SANITARY ARTICLES SUCH AS NAPPIES, AND A PACKET OF COMPRESSED SANITARY ARTICLES THEREBY PACKAGED

[75] Inventor: Jean Roussel, Teteghem, France

[73] Assignee: Peaudouce, Linselles, France

[21] Appl. No.: 81,246

[22] PCT Filed: Dec. 20, 1991

[86] PCT No.: PCT/FR91/01039

§ 371 Date: Aug. 24, 1993

§ 102(e) Date: Aug. 24, 1993

[87] PCT Pub. No.: WO92/12069

PCT Pub. Date: Jul. 23, 1992

[30] Foreign Application Priority Data

Dec. 26, 1990 [FR] France ..... 90/16280

[51] Int. Cl.[6] ..... B65D 75/58; B65D 33/36

[52] U.S. Cl. ..... 206/494; 221/64; 383/66; 383/200

[58] Field of Search ..... 206/494, 83.5, 440; 221/56, 58, 59, 64, 279; 383/4, 200, 66

[56] References Cited

U.S. PATENT DOCUMENTS

| | | | |
|---|---|---|---|
| 4,934,535 | 6/1990 | Muckenfuhs | 206/494 |
| 4,966,286 | 10/1990 | Muckenfuhs . | |
| 5,050,742 | 9/1991 | Muckenfuhs | 206/494 X |
| 5,054,619 | 10/1991 | Muckenfuhs | 206/494 X |
| 5,065,868 | 11/1991 | Cornelissen | 206/494 |

FOREIGN PATENT DOCUMENTS

0349050A3 1/1990 European Pat. Off. .

*Primary Examiner*—Bryon P. Gehman

*Attorney, Agent, or Firm*—Burns, Doane, Swecker & Mathis

[57] ABSTRACT

A bag of flexible material for packaging compressible products includes a side of the bag perpendicular to the direction in which the products are compressed having a pouch of material that extends into the bag, The pouch allows expansion of the bag upon opening and a subsequent decompression of the products to facilitate removal from the bag. A tear-away opening portion of an adjacent top side of the bag releases edges of the pouch which allows the bag to expand, The bag may be used for packaging sanitary absorbent articles such as diapers.

14 Claims, 6 Drawing Sheets

FLEXIBLE BAG FOR PACKAGING COMPRESSIBLE PRODUCTS, PARTICULARLY SANITARY ARTICLES SUCH AS NAPPIES, AND A PACKET OF COMPRESSED SANITARY ARTICLES THEREBY PACKAGED

The present invention relates to a bag in flexible material for the packaging of products compressed in one direction, for example hygiene products such as nappy-pants, formed from a flexible envelope surrounding and holding the products in the compressed state and comprising means for opening the envelope with a view to removing the products, and to a pack of compressed hygiene products packaged in such a bag.

In a bag of this type known from Application EP-A-349,050 and U.S. Pat. No. 4,966,286, the opening means are defined by lines of perforations made in a wall of the bag which is perpendicular to the direction of compression of the compressed products. In order to prevent the compressed products from escaping from the bag at the moment of opening, provision is made for the opening defined by the perforation lines to have a width which is smaller than the width of the products and, preferably, a width which increases towards the bottom. Provision is also made for the opening defined by the lines of perforations to extend only over part of the height of the products.

However, use has revealed that this known package is not entirely satisfactory, particularly if the products contained in the package are highly compressed, for example up to 50% as is desirable in the case of hygiene articles such as nappy-pants, in order to reduce the storage and transportation volume. In fact, extraction of the products one by one from such a package poses problems in that, due to their high degree of compression, those products closest to the opening tend to emerge by themselves via the opening thus created, or several tend to emerge simultaneously when a pulling action is exerted on the product closest to the opening.

The object of the present invention is to create a bag for the packaging of compressible products, which bag permits extraction of the packaged products in a simple manner, one by one, from the package, even when they are under a high degree of compression. A further object of the invention is to create a pack of compressed hygiene products packaged in such a bag in a particularly compact form, with means for permitting easy extraction of the hygiene products, one by one, without the risk of the products escaping prematurely.

The bag according to the invention for the packaging of products compressed in one direction, for example of hygiene products such as nappy-pants, is formed from a flexible envelope surrounding and holding the products in the compressed state and comprising means for opening the envelope with a view to removing the products. According to the invention, the envelope also comprises, on a first side of the bag which is perpendicular to the direction of compression of the products, expansion means enabling the user to increase the inner volume of the envelope uniformly over substantially the whole of the said first side in order to decompress the products, and the said opening means are provided on a second side of the bag in a zone adjacent to the said first side.

The said expansion means preferably comprise an envelope wall reserve and means for holding this wall reserve in an inactive position, that is to say in a reserve position. It is thus only when the user puts the envelope wall reserve into action that an increase in the inner volume of the envelope, and thus a decompression of the products, is produced, which greatly facilitates their removal one by one.

The said expansion means may comprise an envelope part extending in the manner of a pouch towards the inside of the envelope and immobilisation means for holding this envelope wall part in the form of a pouch inside the envelope.

The bag according to the invention may preferably have a general parallelepipedal shape and contain at least one horizontal stack of nappy-pants arranged vertically and compressed in the horizontal stacking direction. In this case, the expansion means are provided on a vertical side of the bag, substantially over the entire height of the said side. The opening means are, moreover, provided on the top of the bag, in a zone adjacent to the said vertical side. Thus, after expansion and opening of the bag, there is no risk of the products escaping from the bag by themselves in any way, and their removal via the top of the bag is greatly facilitated.

The envelope part forming an envelope wall reserve may consist either directly of a surface portion of the envelope, deformed into a bellows, or of a portion attached to the envelope.

The means for immobilisation of the envelope wall reserve advantageously comprise means for joining the edges of the envelope part in the form of a pouch, for example by gluing or welding.

In order to facilitate the expansion of the volume of the package, it is advantageous for the said immobilisation means to comprise, moreover, means for ripping or tearing off.

A more detailed description will be given below of several illustrative and non-limiting embodiments of a packaging bag according to the invention, of the method for manufacturing this packaging bag and of the pack of compressed hygiene articles packaged in such a bag, with reference to the appended diagrammatic drawings; in the drawings.

Figure 2:
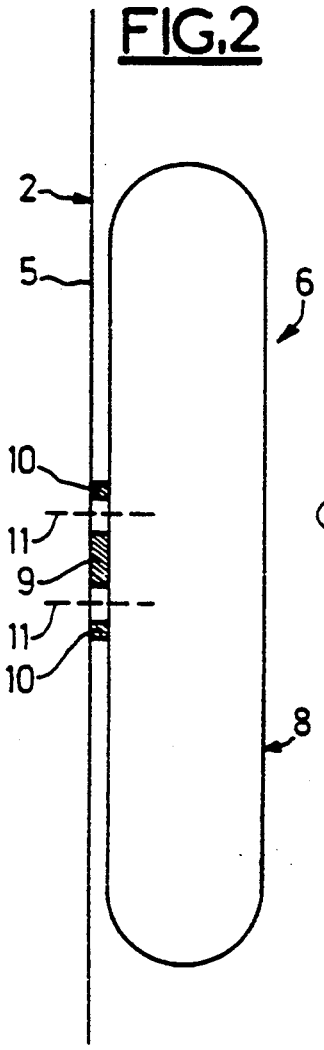
FIG. 2 shows, on a larger scale, an embodiment of the envelope wall reserve of the bag according to the invention.
Figure 4:
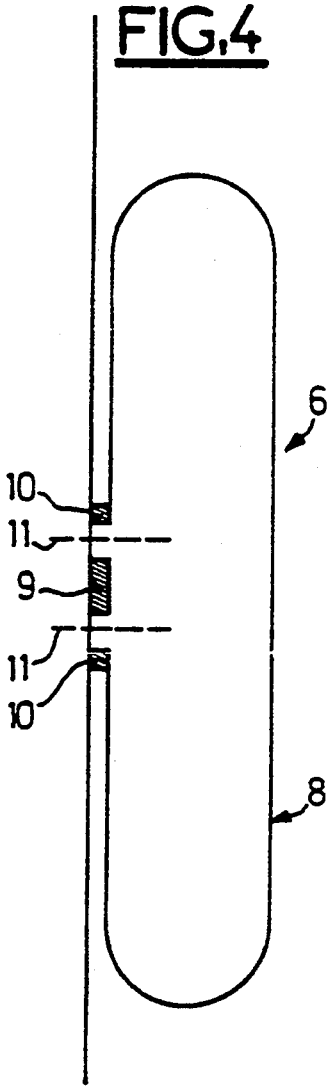
Figure 6:
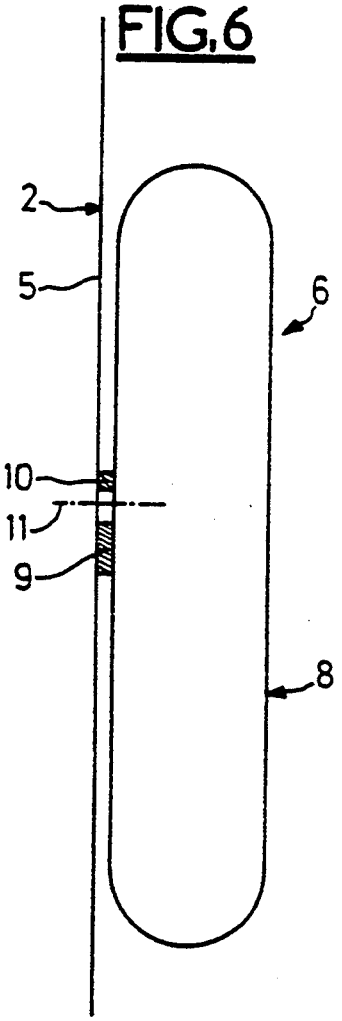
Figure 8:
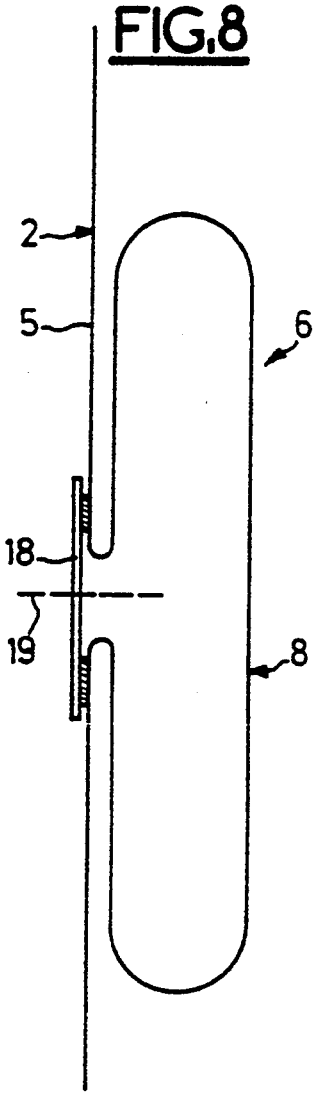

FIGS. 3*a* to 3*e* show different stages in the manufacture of a packaging bag comprising an envelope wall reserve according to FIG. 2;

FIG. 4 shows, on a larger scale, a variant of an envelope wall reserve;

FIGS. 5*a* to 5*e* show different stages in the manufacture of a bag comprising an envelope wall reserve according to FIG. 4;

FIG. 6 shows, on a larger scale, a further variant of a packaging wall reserve;

FIGS. 7*a* to 7*e* show different stages in the manufacture of a bag comprising an envelope wall reserve according to FIG. 6;

FIG. 8 shows, on a larger scale, yet a further variant of a packaging wall reserve;

FIGS. 9*a* to 9*d* show different stages in the manufacture of a bag comprising an envelope wall reserve according to FIG. 8;

FIGS. 10*a* to 10*h* show different stages in the manufacture of a parallelepipedal packaging bag, with a handle, for compressed hygiene articles, and the method of opening and expansion of the pack of hygiene articles which is formed from a stack of hygiene articles compressed in such a bag.

Figure 1:
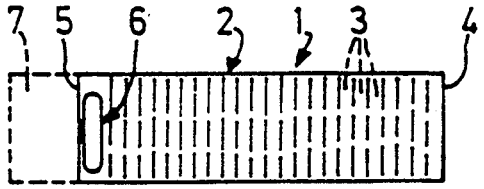
FIG. 1 is a diagrammatic transverse section of a packaging bag according to the invention, illustrating the principle of expansion of the bag.

As illustrated diagrammatically, in section, in FIG. 1, a bag 1 for the packaging of compressible products, for example hygiene products such as nappy-pants, comprises a flexible envelope 2, preferably in plastic sheet, surrounding and holding the products in the compressed state. In the example of FIG. 1, nappy-pants 3 are arranged vertically in the form of a horizontal stack between the two opposite vertical small sides 4, 5 of the bag 1, having, overall, an essentially parallelepipedal shape. Nappy-pants 3 are compressed in the direction of their stacking, that is to say, in FIG. 1, perpendicularly to the two opposite vertical small sides 4, 5 of the bag 1.

The bag 1 comprises, according to FIG. 1, at the location of the vertical small side 5, an envelope wall reserve 6 arranged inside the envelope 2. This reserve 6 is intended to permit, on opening of the bag 1, with a view to removing the nappy-pants 3, an expansion of the inner volume of the bag 1 in the direction of an increase in the horizontal perimeter of the envelope 2, as indicated at 7 in broken lines in FIG. 1.

As shown in FIG. 2, the envelope wall reserve 6 consists of a pouch 8 produced, for example, in the same sheet material as the envelope 2, the pouch 8 being connected to the vertical wall 5, inside the latter, over all or part of the height of the bag 1, by means of a central weld 9 flanked by two lateral welds 10 extending at a short distance and parallel to the central weld 9. There is thus available, between the central weld 9 and each of the lateral welds 10, a zone having a double thickness, one thickness being formed by the envelope 2 and the other by the pouch 8.

In order to permit the expansion of the inner volume of the bag 1, it suffices for the user to make a cut in the double thickness of sheet between the central weld 9 and one and/or the other of the two lateral welds 10, in the plane or planes referenced 11, so that, under the pressure of the products contained in the compressed state in the envelope 2, the envelope wall reserve 6 is brought into the active position, that is to say the pouch 8 is eliminated, the wall length previously held in reserve in the form of a pouch 8 inside the envelope 2 being released in order to permit an increase in the perimeter of the envelope 2, as indicated at 7 in FIG. 1. The products packaged in the compressed state in the bag 1 can thus expand, that is to say relax into the additional volume thus created, which facilitates their extraction from the bag.

A method of manufacture of the bag comprising an envelope wall reserve 6 according to FIG. 2 is illustrated by FIGS. 3*a* to 3*e*.

Figure 3A:
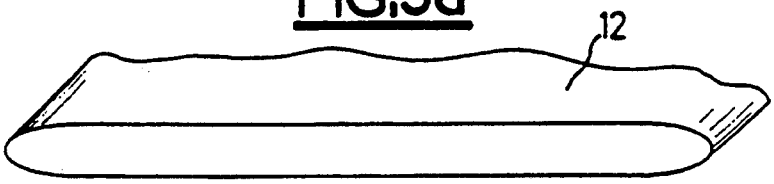

According to FIG. 3*a*, the pouch is formed in a tubular sheath section 12 in plastic sheet.

Figure 3B:
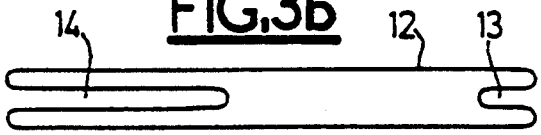

According to FIG. 3*b*, the sheath section 12 is equipped with a fold in the form of a bellows 13, of shallow depth, on a first of its two opposite lateral edges, and a fold in the form of a bellows 14, of greater depth, along its second lateral edge.

Figure 3C:
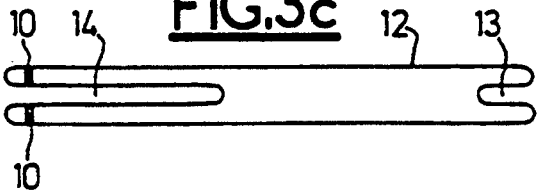

During the following operation illustrated by FIG. 3*c*, two welds 10 are made in order each time to join the two thicknesses of sheet of the two branches of the bellows 14, at a short distance from the free end of the said branches.

Figure 3D:
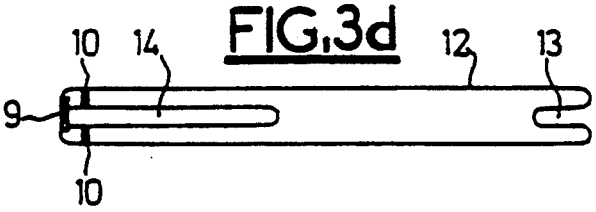

Next, according to FIG. 3*d*, a weld 9 is made in order to join the said two branches at their free ends.

Figure 3E:
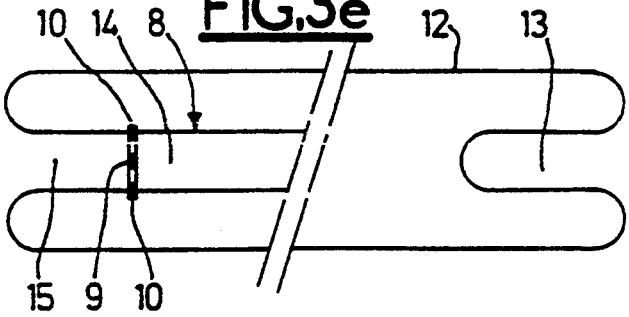

Finally, according to FIG. 3*e*, the bellows 14 is deformed further towards the inside in order to increase the depth of the bellows 14 by an amount corresponding to the depth of the opposite bellows 13, which gives rise to an outer bellows 15 whose bottom is defined by the welds 9, 10, whilst the inner bellows 14 extending from the welds 9, 10 towards the inside forms the pouch 8 forming the envelope wall reserve 6 according to FIGS. 1 and 2.

The envelope wall reserve 6 according to FIG. 4 differs from that in FIG. 2 in that a single thickness of sheet is provided in the zones between the central weld 9 and the two lateral welds 10 of the pouch 8 and of the wall 5 of the envelope 2. Here, also, it suffices for the user to make a cut in one and/or the other of these two intermediate zones according to the planes referenced 11 in order to enable the envelope 2 to increase its perimeter by the amount of the pouch 8 with a view to the expansion of the nappy-pants contained in the bag.

Figure 5A:
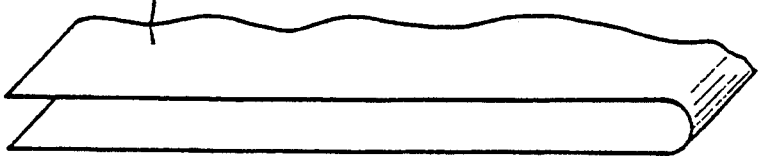
Figure 5B:
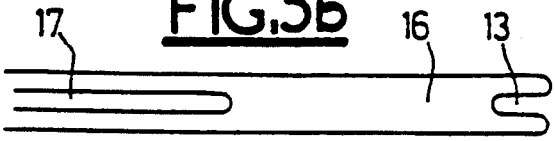

In order to form an envelope 2 with an envelope wall reserve 6 according to FIG. 4, the packaging bag is manufactured, according to FIG. 5*a*, from a single sheath section 16 folded in two. Along the folded edge, the sheath section 16 is deformed towards the inside in the form of a bellows 13. On the second open edge, in order to form a bellows, a sheath strip 17, itself folded in two so that its folded edge is turned towards the inside of the sheath section 16 and its two branches are turned in the same direction as the two branches of the sheath section 16 (see FIG. 5*b*), is introduced into the sheath section 16.

Figure 5C:
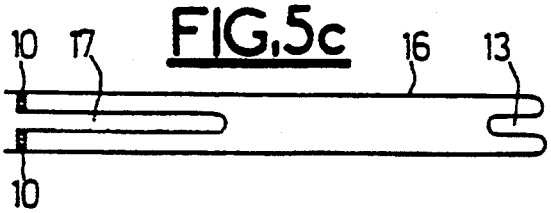

As shown in FIG. 5*c*, each branch of the strip 17 is next connected to the corresponding branch of the sheath section 16 in a position slightly set back towards the inside relative to the free ends of the branches of the sheath section 16.

Figure 5D:
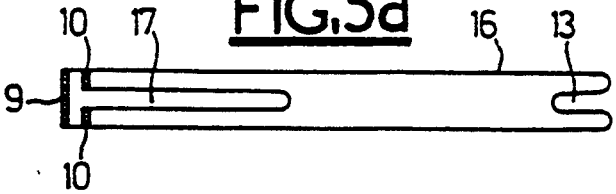

Moreover, according to FIG. 5*d*, the free ends of the edges of the sheath section 16 are joined together by a weld 9.

Figure 5E:
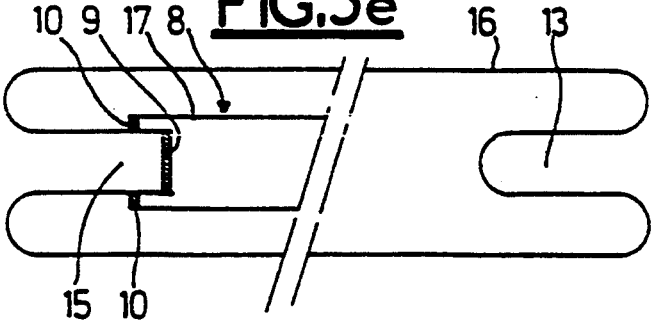
Figure 7A:
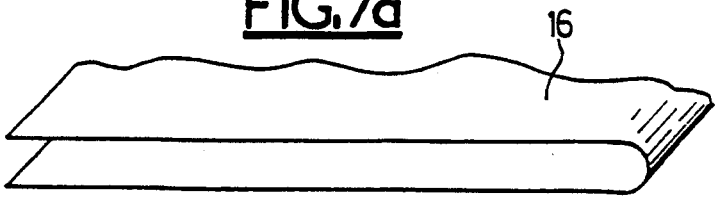

Next, according to FIG. 5*e* and in a manner similar to FIG. 3*e*, the whole arrangement comprising the strip 17 and the welds 9 and 10 is deformed more deeply towards the inside in order to form an outer bellows 15 having the same depth as the bellows 13, the strip 17 then forming the pouch 8 of the envelope wall reserve 6 in FIG. 4.

According to a further variant illustrated in FIG. 6, the envelope wall reserve 6 consists of a pouch 8 connected to the wall 5 of the envelope 2 by two parallel welds 9, 10, a double thickness of sheet being provided between the said two welds. In order to eliminate the pouch 8, it suffices for the user to cut the zone of double thickness between the two welds 9 and 10, for example according to the plane 11.

Figure 7B:
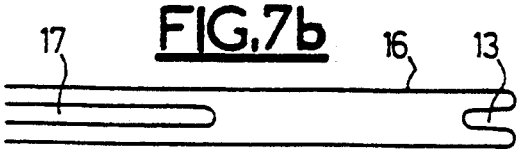
Figure 7C:
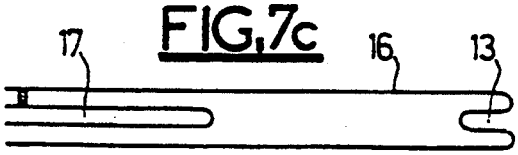
Figure 7D:
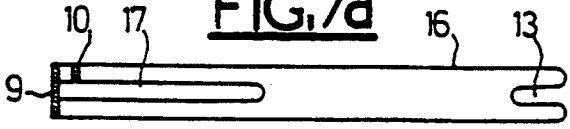
Figure 7E:
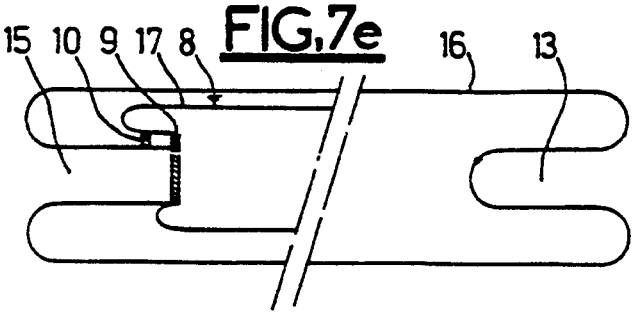

In order to produce an envelope 2 with an envelope wall reserve 6 according to FIG. 6, the starting point is again a sheath section 16 folded in two (FIG. 7*a*), a bellows 13 is formed along the folding edge, and a sheath strip 17 folded in two is inserted in the sheath section 16 on the other open edge of the latter (FIG. 7*b*). Next, a weld 10 is made between one of the branches of the strip 17 and the corresponding branch of the sheath section 16, in a position slightly set back relative to the free ends of the said branches (FIG. 7*c*). A weld 9 is then made between the free ends of the two branches of the strip 17 and the free ends of the two free branches of the sheath 16 (FIG. 7*d*).

Finally, after having deformed the whole arrangement comprising the strip 17 and the welds 9, 10 more deeply towards the inside, an outer bellows 15 is formed at this location, the strip 17 forming the pouch 8 of the envelope wall reserve 6 according to FIG. 6.

FIG. 8 shows a preferred embodiment of the envelope wall reserve 6 on the wall 5 of the envelope 2 of a packaging bag according to the invention. As in the embodiment of FIGS. 2 and 3, the pouch 8 of the envelope wall reserve 6 is formed, here, directly in the material of the envelope 2 of the bag, by deformation of the wall 5 of the envelope 2 inwards in the form of a pouch 8. On the other hand, instead of holding this pouch 8 in an inactive position, that is to say in a reserve position, by means of welds directly between the wall parts of the envelope, provision is made here to use an attached band 18, for example an adhesive band or a welded band, in order to hold the connecting edges of the pouch 8 connected to the wall 5 of the envelope 2.

In order to release the pouch 8, that is to say to permit the expansion of the inner volume of the bag by an increase in the perimeter of the envelope 2, the user may either tear off the strip 18 when the latter is an adhesive strip, or cut or rip the strip 18 in a plane referenced 19 in FIG. 8.

Figure 9A:
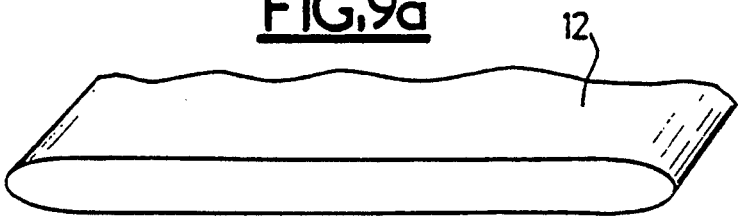
Figure 9B:
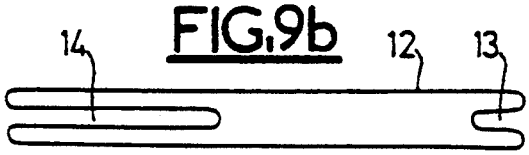
Figure 9C:
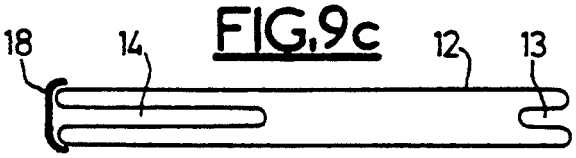
Figure 9D:
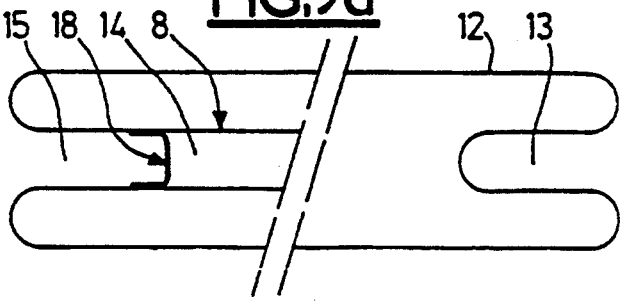

The envelope 2 comprising an envelope wall reserve 6 according to FIG. 8 is manufactured from a tubular sheath section 12 (FIG. 9*a*) which is equipped on one edge with a bellows 13 and on the opposite edge with a deeper bellows 14 (FIG. 9*b*). The strip 18 is then placed between the free ends of the two branches of the bellows 14 (FIG. 9*c*). Finally, as in the embodiment of FIG. 3, the bellows 14 forming the pouch 8 is deformed more deeply inwards in order to form an outer bellows 15 of a depth corresponding to that of the bellows 13 (FIG. 9*d*).

Figure 10A:
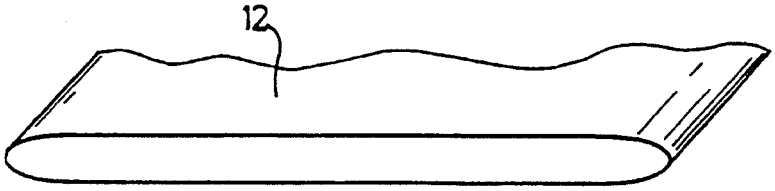
Figure 10B:
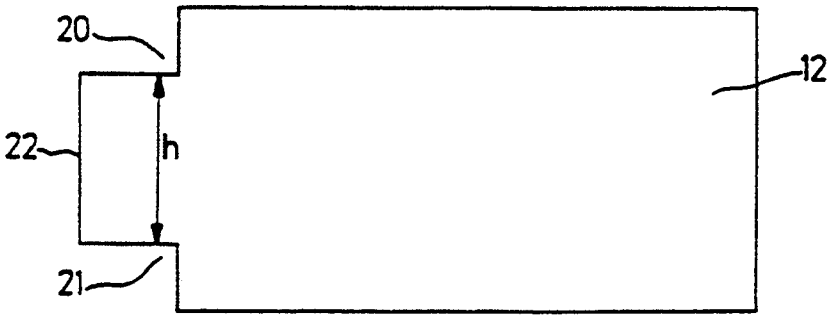
Figure 10C:
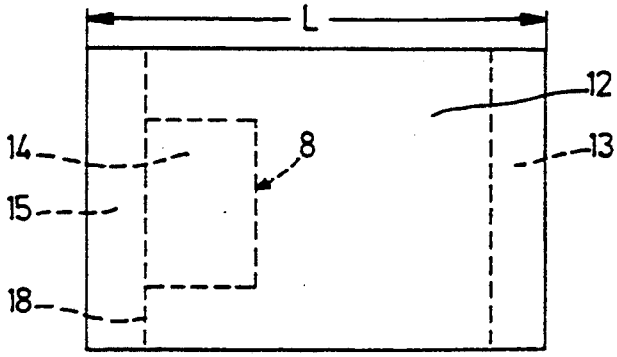
Figure 10D:
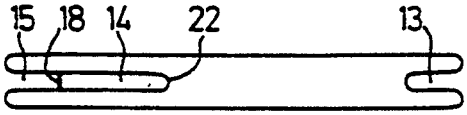
Figure 10E:
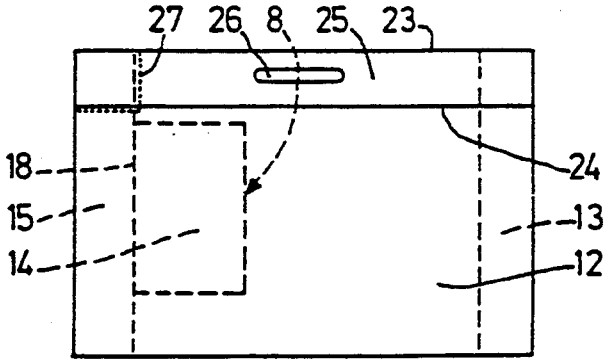
Figure 10F:
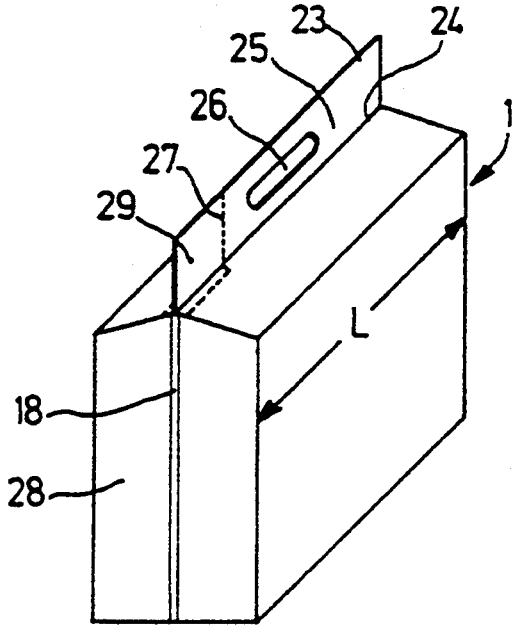
Figure 10G:
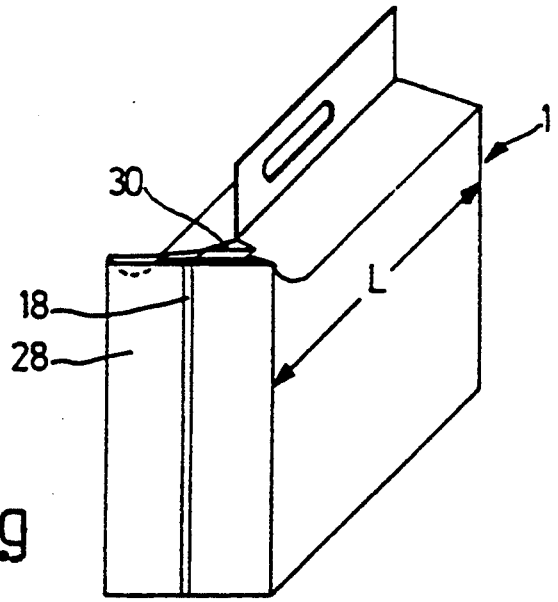

Whereas FIGS. 2 to 9 illustrate several embodiments of expansion means provided on the packaging bag according to the invention, FIGS. 10*a* to 10*e* show different stages in the manufacture of a preferred specific illustrative embodiment of a packaging bag according to the invention, and FIGS. 10*f* to 10*g* illustrate a pack of nappy-pants or of similar products compressed in such a bag, respectively before opening, after opening and after expansion of the bag of the pack.

According to FIG. 10*a*, the packaging bag is manufactured from a tubular sheath section 12.

In a first stage, as shown in FIG. 10*b*, a rectangular notch 20, 21 is cut in each of the two corners of a first of the two opposite lateral edges of the sheath section 12. The two notches 20, 21 have the same depth perpendicularly to the lateral edges, but the upper notch 20 has, here, parallel to the lateral edges, a height which is greater than the lower notch 21. It should be noted that the height h of the part 22 remaining between the two notches 20 and 21 is less than or equal to one of the dimensions of the products to be packaged in the bag, as will become apparent hereinbelow.

In a similar manner to FIG. 9*b*, the second lateral edge of the sheath section 12 is next folded inwards in the form of a bellows 13, and, in a first stage, the part 22 is folded inwards over the first edge, over the depth of this part 22, the latter thus forming the bellows 14. In this position a joining strip 18 is placed, connecting together the free ends of the two branches on the said edge. Next, according to FIGS. 10*c* and 10*d*, the said first edge is deformed more deeply inwards so that the strip 18 delimits, towards the inside, a pouch 8 defined by the part 22 and, towards the outside, a bellows 15 having the same depth as the opposite bellows 13, in a similar manner to FIG. 9*d*. The sheath 12 then has a width L.

Two transverse weld lines 23 and 24 are next made on the sheath section 12, the first in the vicinity of the upper edge of the sheath section 12 and the second at a distance below the first so as to delimit a panel 25. At the same time, a cut 26, acting as a handle hole, is made in the two folds of the sheath section 12, between the two weld lines 23 and 24, and a line of perforations 27 is made in the two folds, which line comprises a vertical branch extending from the weld line 23 downwards through the panel 25 as far as a distance below the weld line 24 being slightly offset inwards relative to the joining strip 18, and a horizontal branch extending outwards at a distance below the weld line 24.

All these operations are carried out on the folded sheath section 12, which is arranged flat, and thus affect the two folds of the sheath section 12.

The sheath section 12 thus prepared forms a packaging bag with bellows, closed at the top, on the handle side, but still not closed on the bottom side, which is next opened in order to introduce compressed nappy-pants therein via the bottom, before closing the bottom in the conventional manner, for example by a weld made in the vicinity of and along the lower transverse edge in FIG. 10*e*.

FIG. 10*f* shows the pack thus obtained permitting the storage and the transportation of nappy-pants in the compressed state, in a reduced volume.

It will be noted, on the pack of FIG. 10*f*, that the bellows 15 of the packaging bag according to FIG. 10*e* is deployed, on opening of the packaging bag with a view to inserting the nappy-pants in the compressed state, on the vertical small side 28 of the parallelepipedal pack, the opposite bellows 13 being deployed on the opposite vertical small side which is not visible in FIG. 10*f*. The joining strip 18 which extends over the entire height of the pack will also be noted on the said side 28.

Figure 10H:
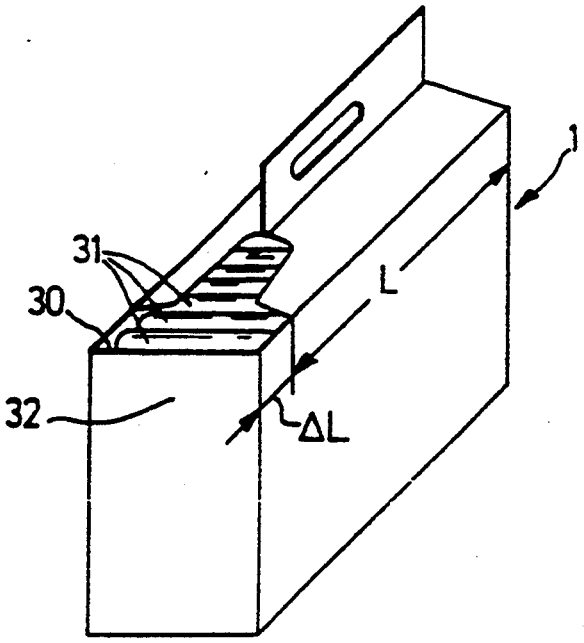

It should be noted that, as will become apparent, above all, in FIG. 10*h*, the nappy-pants contained in the compressed state in the pack according to FIG. 10*f* are arranged in parallel vertical planes in the form of a horizontal stacking between the small side 28 and the opposite small side of the pack, the horizontal "height" of this stacking, that is to say the length L of the parallelepipedal pack, corresponding to the width L of the sheath section 12 according to FIGS. 10*c* and 10*d*.

With a view to opening the pack according to FIG. 10*f*, the user seizes the part 29 of the panel 25 delimited by the line of perforations 27 and exerts a pulling action on the said part 29 in order to cause its tearing-off along the line of perforations 27. Given that the line of perforations 27 passes not only into the panel 25 delimited by the two weld lines 23 and 24, but also below the weld line 24, this tearing-off of the part 29 causes opening of the bag 1 on the top of the latter, in a zone adjacent to the vertical small wall 28. This opening referenced 30 in FIG. 10*g* has virtually the shape of a rectangle or of a trapezium which becomes wider in the direction of the wall 28.

Making the opening 30 in the top of the pack by tearing off the part 29 does not cause a modification of the length L of the pack.

The nappy-pants 31 contained in the packaging bag 1 are then accessible via the upper opening 30 but, due to their compression, their extraction one by one from the pack is difficult, and even impossible.

In order to permit decompression of the nappy-pants contained in the pack by expansion of the inner volume of the package 1, the user next tears off or rips the joining strip 18 from the upper opening 30 as far as the bottom of the pack. The tearing-off or ripping of the strip 18 releases the bellows 14, that is to say the pouch 8 forming the envelope wall reserve, so that, under the pressure of the nappy-pants 31 contained in the package 1, the latter extends over its entire height by an amount referenced ΔL in FIG. 10*h*. Due to the decompression they thus undergo, the nappy-pants 31 can next be withdrawn without difficulty one by one via the upper opening 30 whose size has consequently increased.

It should be noted that the end wall 32 possessed by the packaging bag 1 after this expansion extends over the entire height of the nappy-pants 31. The nappy-pants 31 are thus perfectly held in position in the bag 1 and can be extracted upwards via the upper opening 30 without any risk of the nappy-pants escaping prematurely via the opening 30 which is parallel to the direction of compression of the nappy-pants 31. Compared with packs of compressed nappy-pants on which the extraction opening is located in a wall which is perpendicular to the direction of compression of the nappy-pants, this position of the extraction opening 30, combined with the decompression effect of the nappy-pants by means of the expansion of the inner volume of the package, gives the pack according to the invention markedly increased ease and reliability in use, even with higher degrees of compression of the packaged nappy-pants.

It should be noted that the embodiments described hereinabove and shown in the appended drawings are no more than illustrative and non-limiting examples and that numerous modifications and variants are possible within the scope of the invention.

Thus, different modes of closure and of folding can be envisaged for the top and the bottom of the bag, in which case the dimensions of the notches 20 and 21 may be different from those indicated in FIG. 10*b*.

The packaged products which may be products other than nappy-pants maybe contained in the form of several horizontal stacks juxtaposed or superposed in the pack. Moreover, the products of rectangular shape disposed in the vertical parallel planes, instead of being placed upright as in FIG. 10*h*, their large sides being vertical, could also lie down, their large sides being horizontal. In this case, the height h of the part 22 in FIG. 10*b*, instead of corresponding to the large dimension of the products, would correspond to the small dimension of the latter.

Within the scope of the invention, it would also be possible to place the products in horizontal planes in the form of one or more vertical stacks, in which case the removal opening could be located on one of the vertical walls and the envelope wall reserve on one of the horizontal walls (top or bottom).

Similarly, it would be possible to provide opening means on a vertical wall and the envelope wall reserve on another vertical wall of the bag or pack.

I claim:

1. A bag made of flexible material for packaging products compressed in one direction, the bag surrounding and holding the products in a compressed state, the bag comprising:

expansion means on a first side of the bag, the first side being perpendicular to the direction of compression of the products, the expansion means having a pouch shape and extending toward the inside of the bag;

immobilization means for holding the expansion means in the pouch shape inside the bag; and, opening means provided on a second side of the bag in a zone adjacent to the first side, wherein upon opening the bag using the opening means, the expansion means permits the inner volume of the bag to increase uniformly over substantially the whole of the first side resulting in a decompression of products in the bag.

2. A bag according to claim 1, wherein the expansion means include a surface portion of flexible material deformed into a bellows.

3. A bag according to claim 2, wherein the surface portion is formed integrally with the bag.

4. A bag according to claim 2, wherein the surface portion is a separate portion of material attached to the bag.

5. A bag according to claim 1, wherein the immobilization means comprise means for joining edges of the pouch-shaped expansion means by one of gluing and welding.

6. A bag according to claim 1, wherein the immobilization means further comprise means for ripping the immobilization means to release the expansion means.

7. A bag according to claim 1, wherein the compressed products are nappy pants.

8. A bag according to claim 1, wherein the bag has a parallelpipedal shape and contains at least one horizontally directed stack of the products compressed in the direction of stacking, and wherein the first side is a vertical side of the bag and the expansion means are provided over substantially the entire height of the vertical side and the opening means are provided on the top of the bag.

9. A bag according to claim 8, wherein the expansion means consist of a surface portion of flexible material deformed into a bellows.

10. A bag according to claim 9, wherein the surface portion is formed integrally with the bag.

11. A bag according to claim 9, wherein the surface portion is a separate portion of flexible material attached to the bag.

12. A bag according to claim 8, wherein the immobilization means comprise means for ripping the immobilization means to release the expansion means.

13. A bag according to claim 8, wherein the immobilization means comprise means for joining edges of the pouch-shaped expansion means by one of gluing and welding.

14. A package of compressed nappy-pants comprising:

a bag made of flexible material surrounding and holding the nappy-pants compressed in one direction, the nappy-pants being arranged vertically parallel in at least one horizontally directed stack within the bag;

a pouch formed on a vertical wall of the bag which is perpendicular to the direction of compression of the nappy-pants, the pouch extending toward an interior of the bag;

means for maintaining the pouch in position in the bag; and, opening means provided in a top wall of the bag in a zone adjacent to the vertical wall, wherein upon opening of the bag using the opening means, the pouch is released to provide a uniform increase of the inner volume of the bag over substantially the entire height of the vertical wall, resulting in a decompression of the nappy-pants which facilitates the removal of the nappy-pants from the bag.

* * * * *